United States Patent [19]

Howell

[11] 4,116,404

[45] Sep. 26, 1978

[54] AUTOMATIC BALANCING CONCEPT

[75] Inventor: Thomas H. Howell, Huntsville, Ala.

[73] Assignee: The United States of America as represented by the Secretary of the Army, Washington, D.C.

[21] Appl. No.: 818,188

[22] Filed: Jul. 22, 1977

[51] Int. Cl.[2] ..... F42B 15/02

[52] U.S. Cl. ..... 244/3.23; 244/3.1

[58] Field of Search ..... 244/3.23, 3.24, 3.22, 244/3.21, 3.1

[56] References Cited

U.S. PATENT DOCUMENTS 2,774,305 12/1956 Fitzgerald et al. ..... 244/3.21

2,980,363 4/1961 Schonstedt ..... 244/3.22

*Primary Examiner*—Charles T. Jordan

*Attorney, Agent, or Firm*—Nathan Edelberg; Robert P. Gibson; Charles R. Carter

[57] ABSTRACT

An automatic balancing concept including two annular containers used to dynamically balance a rocket during flight. The containers are partially filled with a high density fluid and are installed forward and aft of the longitudinal CG of the rocket. When spin is induced in the rocket the radial CG will shift to the spin axis and the fluid will couple itself to the outside diameter of the ring.

3 Claims, 10 Drawing Figures

$\Delta\alpha N = (\alpha N_1 - \alpha N_2)$ $\Delta P = (P_1 - P_2)$

AUTOMATIC BALANCING CONCEPT

DEDICATORY CLAUSE

The invention described herein may be manufactured, used, and licensed by or for the Government for governmental purposes without the payment to me of any royalties thereon.

BACKGROUND OF THE INVENTION

This invention relates to the field of rockets. Rotating components produce transverse loads when the principle line of inertia (PLI) is not coincident with the spin axis. These transverse loads are defined by the magnitude of the PLI malalignment and the spin rate. The forces cause excessive vibrations, bearing wear, accelerate fatigue and numerous other ill effects. To balance or null these side loads, counterweights are added to effect alignment of the PLI with the spin axis, and it should be valid until mechanized properties change. One can experience this phenomena by driving an automobile with a wheel out-of-balance which causes wheel "hop". This effect creates undesirable effects within freeflight rockets. The thrust vector is normally rotated 10–15 revolutions during rocket burning time to decrease the effects of a thrust malalignment factor. Induced spin rate at the time of launcher release generates a precession rate (gyroscopic) whose magnitude is defined as the product of the PLI malalignment and the spin rate. The precession or mallaunch is probably the greatest error source in free rockets.

SUMMARY OF THE INVENTION

Two annular containers having chambers therein are partially filled with a high density fluid such as mercury are installed forward and aft of the longitudinal CG station. When the body is at rest the mercury will be at rest however when spin is induced, the radial CG will shift to the spin axis because the fluid will couple itself to the outside diameter of the chambers. The forces due to unbalance will produce a nutation action of the spin axis about the PLI when the body is spinning in a free-free or soft-sprung mode. This nutation action will cause the fluid medium to align the CG of each ring about the spin axis, forcing the PLI to be coincident.

This invention may be better understood from the following detailed description taken in conjunction with the accompanying drawing.

DESCRIPTION OF THE PREFERRED EMBODIMENT

Figure 1:
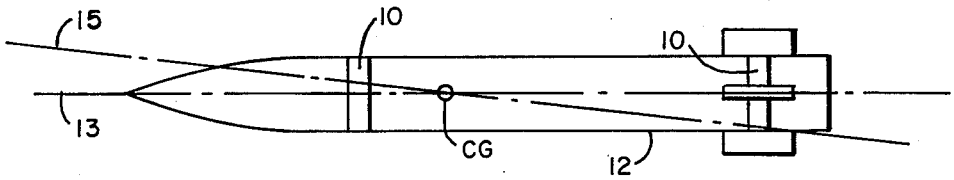
FIG. 1 shows two container assemblies installed forward and aft of the rocket CG.
Figure 2:
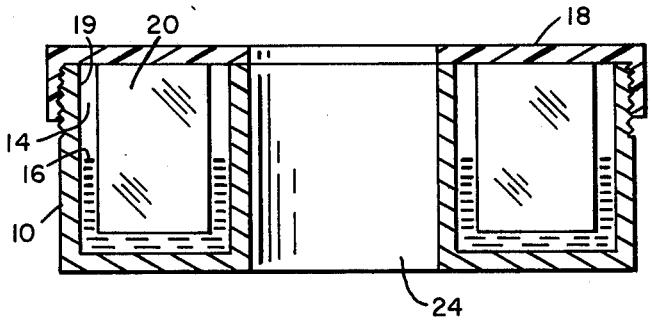
FIG. 2 is a cross section view of one modification of the container assembly.
Figure 3:
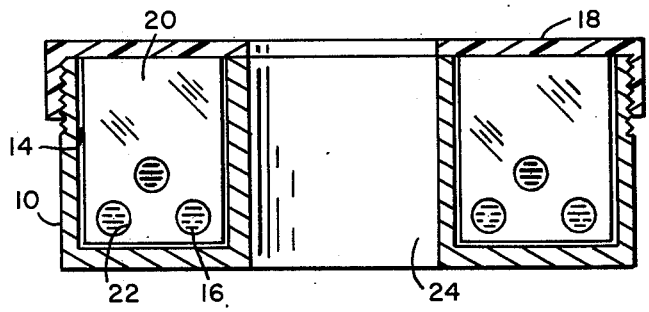
FIG. 3 is a cross section view of a second modification of the container assembly.
Figure 4B:
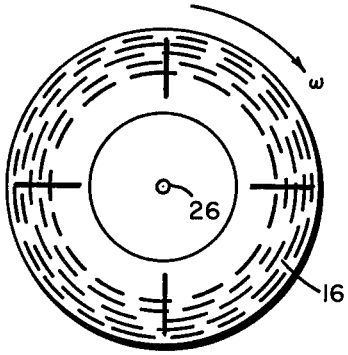
FIG. 4*b* shows the high density fluid coupled to the outside diameter of the chamber.
Figure 4A:
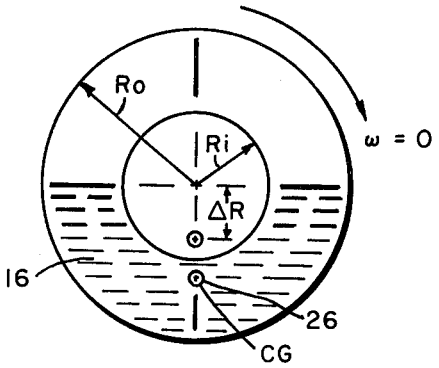
FIG. 4*a* shows the high density fluid at rest in the chamber.

As seen in FIG. 1, two annular containers 10 are placed forward and aft of the longitudinal CG of rocket 12 having a spin axis 13 and a PLI 15. These containers, more clearly shown in FIGS. 2 and 3 include a chamber 14 therein that is partially filled with a high density fluid such as mercury 16. A cover 18 seals the container and is provided with paddles 20 which are attached to the cover 18 on its underside. In the embodiment shown in FIG. 2 the paddles are spaced from the chamber walls to provide room for the mercury to flow. However in the embodiment shown in FIG. 3 the paddles are almost flush with the chamber walls but are provided with openings 22 therein for fluidic movement. The interior of either container assembly is provided with an opening 24 for mounting on a rocket. When the rocket is at rest (no spin) the fluid will seek its own level as shown in FIG. 4*a*. Also the radial CG station of the containers is shown at 26. When spin is induced, the radial CG will shift to the spin axis because the fluid will couple itself to the internal surface 19 of the exterior wall of the chambers. The paddles 20 that are attached to the container cover will angularly accelerate or move the fluid to assist in this coupling. The radial acceleration component due to spin will cause the fluid CG to equalize as seen in FIG. 4*b*.

Figure 5A:
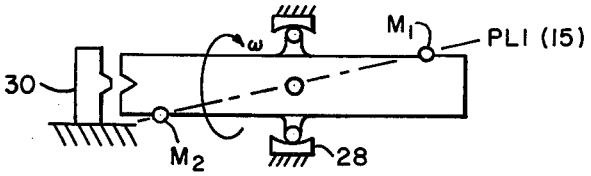
FIG. 5*a* shows the nutation action of the spin axis about the PLI when supported at the gimbal.
Figure 5B:
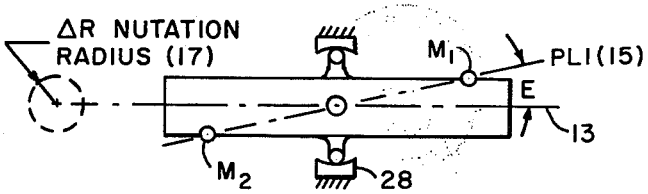
FIG. 5*b* shows the effect when the rocket is uncaged.
Figure 6:
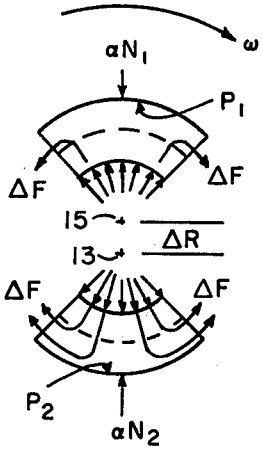
FIG. 6 shows the fluid flow causing a radial CG station change.

Forces due to unbalance will produce a nutation of the spin axis about the principle-line-of-inertia (PLI) 15 when the body is spinning. This effect may be observed when the rocket is supported at the CG with a two degree-of-freedom gimbal 28 seen in FIG. 5*a*. This nutation occurs when the caging restraint 30 is retracted from the rotating body thus creating a free-free spinning mode. Similar effects can be observed when a gyroscope is uncaged or when a rocket leaves the launcher guidance rails. This nutating action, radial deflection 17 of the rocket's spin axis, will cause the fluid medium to flow. This flow will shift the PLI to be coincident with the spin axis 13. This is produced by the following action as shown in FIG. 6:

a. During the unbalance condition the nutation radius $\Delta R$ 17 in FIG. 5*b* generates a differential acceleration in the radial plane, see FIG. 6, $\Delta\alpha_N = \Delta R\omega^2$ which in turn produces a differential static pressure $\Delta P$ inside the container chamber.

b. The $\Delta P$ will create a flow in the chamber which means that the radial CG station of the medium will change. See FIG. 6.

The nutation radius, $\Delta R$ generates a differential normal acceleration $\Delta\alpha_N$ which creates a differential pressure, $\Delta P$ that will effect circumferential flow $\Delta F$ to drive $\Delta R$ to zero.

$$\Delta F = f[\Delta P, \Delta\alpha_N, \Delta R]$$

Figure 8:
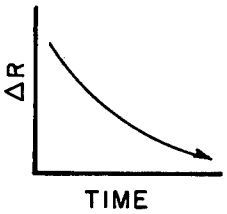
FIG. 8 shows the dampening function of the displacement.
Figure 7:
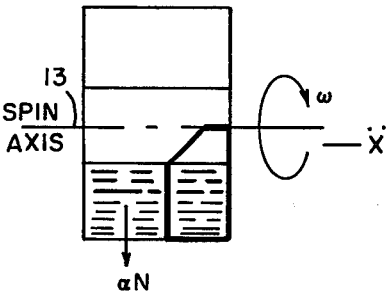
FIG. 7 shows the effect of acceleration vectors on the container.

The flow rate will be controlled primarily by the delta pressure, viscosity of fluid medium, and the effective orifice areas, i.e., clearance between the paddles and the chamber walls or the openings within the perforated paddles. Given an instantaneous malalignment angle E, the $\Delta R$ displacement function would be characteristically dampened as shown in FIG. 8. This assumes that the medium flow characteristics will be responsive to the nutation frequency $\Delta R$. When a longitudinal acceleration, $\ddot{X}$ is imposed on the container chamber assembly the medium again will change form and its shape will adjust to the acceleration vectors as shown in the heavy lined section of FIG. 7. The ratio of the normal, $\alpha_N$ to the longitudinal acceleration component $\ddot{X}$, $\alpha N/X$ will control the form of the medium and even though the $\ddot{X}$ may be an order of magnitude greater than $\alpha_N$, its shape should be symmetrical about the spin axis.

I claim:

1. An automatic system for balancing a rocket during flight said system comprising: two annular containers installed forward and aft of the rocket longitudinal CG station; said containers being provided with a chamber partially filled with high density fluid; a cover for closing said chamber and a plurality of paddles fastened to the underside of said cover and extending into said chamber to angularly accelerate and move the fluid to the outer wall of said chamber thereby aligning the CG of each container about the rocket spin axis.

2. A system as set forth in claim 1 wherein said paddles are spaced from the chamber walls to provide room for the fluid to flow.

3. A system as set forth in claim 1 wherein said paddles are almost flush with the chamber walls and are provided with openings therein for fluidic movement.

* * * * *